US007095163B2

(12) United States Patent
Longo

(10) Patent No.: US 7,095,163 B2
(45) Date of Patent: Aug. 22, 2006

(54) METHOD FOR THE PRODUCTION OF A VISIBLE, UV OR IR RADIATION WITH A LAMP WITHOUT ELECTRODES, AND LAMP THAT CARRIES OUT THIS METHOD

(75) Inventor: Iginio Longo, Pisa (IT)

(73) Assignee: CNR Cosiglio Nazionale Delle Ricerche, Rome (IT)

( * ) Notice: Subject to any disclaimer, the term of this patent is extended or adjusted under 35 U.S.C. 154(b) by 0 days.

(21) Appl. No.: 10/496,302

(22) PCT Filed: Nov. 29, 2002

(86) PCT No.: PCT/IB02/05004

§ 371 (c)(1),
(2), (4) Date: Jun. 1, 2004

(87) PCT Pub. No.: WO03/047318

PCT Pub. Date: Jun. 5, 2003

(65) Prior Publication Data

US 2005/0067976 A1 Mar. 31, 2005

(30) Foreign Application Priority Data

Nov. 29, 2001 (IT) ..... PI2001A0078

(51) Int. Cl.
*H01J 1/02* (2006.01)
*H01J 7/44* (2006.01)

(52) U.S. Cl. ..... 313/17; 315/56

(58) Field of Classification Search ..... 315/248, 315/56; 313/17, 18, 34, 36, 634, 635, 636, 313/638

See application file for complete search history.

(56) References Cited

U.S. PATENT DOCUMENTS

| | | | | |
|---|---|---|---|---|
| 4,189,661 | A * | 2/1980 | Haugsjaa et al. | 315/39 |
| 4,266,167 | A * | 5/1981 | Proud et al. | 315/248 |
| 4,427,923 | A | 1/1984 | Proud et al. | 315/248 |
| 5,013,976 | A * | 5/1991 | Butler | 315/248 |
| 5,239,238 | A * | 8/1993 | Bergervoet et al. | 315/248 |
| 5,899,917 | A * | 5/1999 | Edwards et al. | 606/195 |

(Continued)

FOREIGN PATENT DOCUMENTS

JP 10-015040 1/1998

*Primary Examiner*—Tuyet Vo
*Assistant Examiner*—Minh Dieu A
(74) *Attorney, Agent, or Firm*—Dennison, Schultz & MacDonald

(57) ABSTRACT

A lamp capable of emitting electromagnetic radiation (9), for example visible, IR or UV radiation, exploiting the activation of substances (4) triggered with an antenna (6) irradiating microwaves (8) located inside and insulated, in focal position. Advantageously, the substances (4) are put into a chamber (3) obtained by introduction of a first bulb (1) in a second bulb, in order to form the chamber (3) closed between the walls of the first (1) and of the second bulb (2), the walls of the first bulb defining the recess (5) which houses the antenna (6). A better energy efficiency and a better economy is obtained with respect to the conventional techniques which require introduction of the lamp in a metal vessel crossed by microwaves, or under external microwaves beams. It belongs to the category of lamps without electrodes, because the atoms or the other particles that emit the radiation (8) are neither in contact with the antenna nor with other metal parts. It characterized by a high duration and by the possibility of emitting radiation of modulated wavelength in continuous or pulsed way.

12 Claims, 2 Drawing Sheets

U.S. PATENT DOCUMENTS 5,923,122 A 7/1999 Frank et al. ..... 313/607

6,696,788 B1 * 2/2004 Lapatovich et al. ..... 313/634

* cited by examiner

METHOD FOR THE PRODUCTION OF A VISIBLE, UV OR IR RADIATION WITH A LAMP WITHOUT ELECTRODES, AND LAMP THAT CARRIES OUT THIS METHOD

This application is a filing under 35 USC 371 of PCT/IB02/05004 filed, Nov. 29, 2002.

FIELD OF THE INVENTION

The present invention relates to the production of electromagnetic radiation, continuous or pulsed, in a narrow or wide band wavelength range, extended from the infrared, to the visible, up to the ultraviolet range.

The invention relates in particular to the production of lamps for illumination of closed or open spaces, as well as of spectral power lamps, useful for the treatment of non-metal material, polymers or other biologically interesting material, for sterilization, for processes of chemical and photochemical catalysis, for laser triggering, etc.

DESCRIPTION OF THE PRIOR ART

Lamps without electrodes are known of recent technology (for example vapour metal lamps), triggered by microwaves and used as source of visible and UV radiation. The definition of lamps without electrodes comes from the fact that the atoms or the other particles, present in a bulb and that emit the radiation, are not in contact neither with the source of excitation nor with other metal parts. They are capable of both wide band and spectral emissions, and are characterised by high efficiency as well as by the possibility of pulsed emissions. Such lamps are triggered in a metal vessel crossed by microwaves, or under beams of microwaves coming from an external source.

The advantages of the existing lamps without electrodes are limited by the modality of excitation, which constrains their use within the research sphere, in particular limiting their industrial applicability, such as in the field of illumination. Another reason of the difficult applicability of lamps without electrodes is their size, which cannot be miniaturized.

SUMMARY OF THE INVENTION

It is an object of the present invention to provide a method for the production of a visible, UV, or IR, pulsed or continuous radiation, within either a spectral or wide band wavelength range, without the need of a microwaves metal cavity or in any case a resonating cavity or an external excitation.

It is another object of the present invention to provide a method for the production of such a radiation in a completely electronically controllable way both in power and in frequency.

It is a further object of the invention to provide a lamp without electrodes that carries out this method.

It is a particular object of the invention to provide a lamp without electrodes that can be miniaturized.

It is a further particular object of the invention to provide a lamp without electrodes that can be made industrially and is applicable both for illumination of closed or open spaces and as spectral or power lamp, useful for the treatment of non-metal material, polymers or other biologically interesting material, for sterilization, for processes of chemical and photochemical catalysis, for photographic processes, for laser triggering, for spectroscopic applications.

These and other objects are achieved by the present invention. The method provides the steps of:

creating at least one chamber, closed by an external wall of a substantially transparent material, in which a microwaves irradiation excitable material is put, the at least one chamber having an inner wall for defining at least one recess accessible from the outside;

introducing in the at least one recess at least one source of microwaves radiation, exciting the at least one source according to a predetermined function of power and frequency, the at least one source emitting a radiation with subsequent excitation of the material in the at least one chamber.

According to another aspect of the invention, a lamp without electrodes comprises:

an external wall, of a material substantially transparent to the visible, UV or IR radiation, defining a chamber having inside a microwaves irradiation excitable material, an inner wall that separates the chamber from a recess accessible from the outside;

at least one source of microwaves radiation arranged in the recess, means for exciting the at least one source according to a predetermined function of power and frequency.

Advantageously, the chamber is obtained by means of introduction of a first bulb in a second bulb, in order to form the chamber closed between the walls of the first and of the second bulb, the walls of the first bulb defining the recess.

Preferably, the source is a thin co-axial antenna, put into the recess.

The excitable material may be gas, vapour, dust, or liquid, capable of emitting radiation by activation.

Many adjacent chambers can be provided, triggered by the same source, or more sources are provided that excite the same chamber or more adjacent chambers.

The lamp is capable of emitting radiation with a line spectrum, a band spectrum or mixed spectrum, in a wide range of wavelengths. It works without any electrodes in contact with the particles that emit the radiation, in a continuous or pulsed way. In the second case, the duration of the pulses of the source depends solely by the chemical inertia of the walls of the bulb with respect to the substances contained.

Among the advantages of the invention there is the possibility of a source of light supplied by a microwaves antenna, completely electronically controllable both in power and in frequency, having a particular geometry, for example "re-entering well" geometry, where the antenna is located. The source can be a thin lamp bulb, with useful application where miniaturization is relevant.

BRIEF DESCRIPTION OF THE DRAWINGS

Further characteristics and advantages of the lamp without electrodes and of the method for its production, according to the present invention, will be made clearer with the following description of an embodiment thereof, exemplifying but not limitative, with reference to attached drawings wherein.

DESCRIPTION OF A PREFERRED EMBODIMENT

Figure 1:
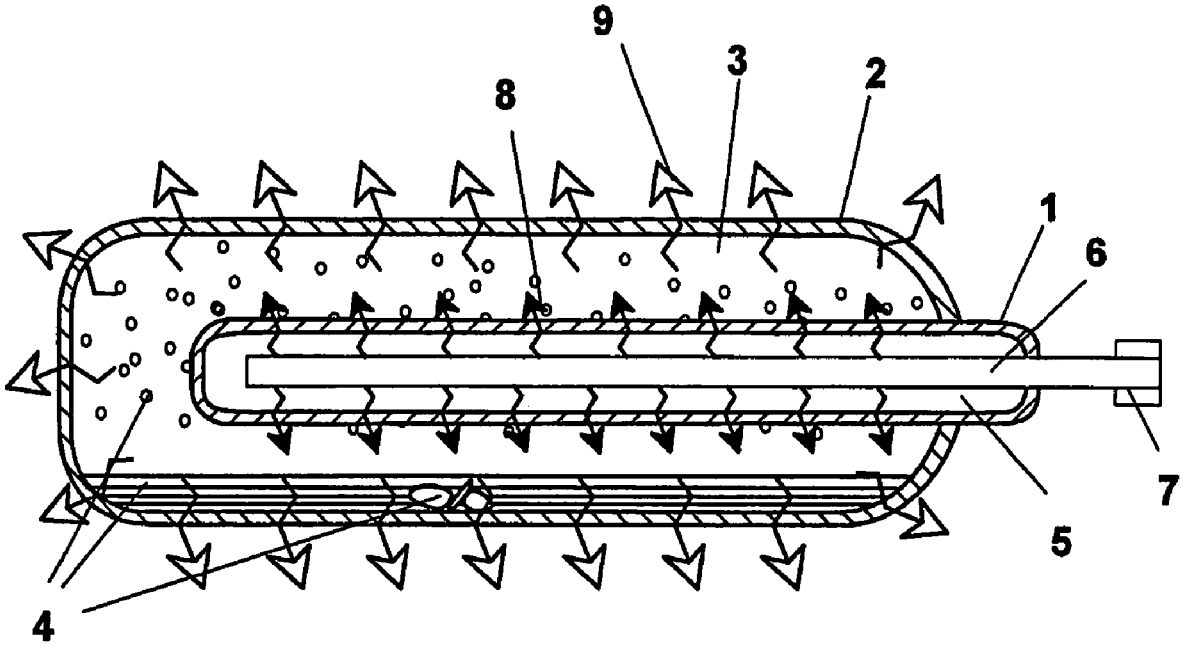
FIG. 1 shows a lamp without electrodes according to the invention.

With reference to FIG. 1, a lamp capable of emitting electromagnetic, continuous or pulsed, radiation consists of a first bulb 1 and a second bulb 2, the former put in the latter and welded together, in order to define a chamber 3 between the respective walls. The first bulb is of a material transparent to microwaves whereas the second bulb is in a material transparent to the objective radiation. Both bulbs can be made of glass. In the present example the two bulbs are axially symmetrical and coaxial.

In chamber 3, before closing it, a material 4 is put capable of emitting a desired radiation by activation. In particular, the material can comprise gas and/or vapour and/or solid and/or liquid substances capable of emitting electromagnetic radiation for excitation with other electromagnetic radiation and/or owing to hits between neutral or ionised particles (atoms or molecules). The material can be put in with either a certain rate of vacuum or at a pressure higher than the atmospheric. A mixture of gases or vapours, or only a single atomic or molecular species can be used.

First bulb 1 defines a recess 5 containing inside an antenna 6, supplied in a known way at an end 7, capable of emitting microwaves radiation 8 of predetermined frequency and power for exciting the gas or the vapour contained in the chamber with the subsequent production of plasma. The emission of a radiation 9 is due to the plasma same or to atoms or molecules present on the surface of chamber 3 and excited by the electromagnetic radiation and/or by hits among the components of the plasma. A fraction or the totality of the excitation radiation 8 is adsorbed by the plasma, whereby the transmission of microwaves out of the lamp can be negligible.

Outer bulb 2 and inner bulb 1, having a whichever desired shape, can be formed as a single body of glass, for example shaped as a "re-entering well", i.e. forming recess 5 where microwaves antenna 6 is located, to avoid the contact between antenna 6 same and plasma chamber 3.

The spectral composition of the radiation as emitted depends from the substances used for filling the bulb, their quantity ratio, as well as the power and the frequency of the microwaves used for excitation.

Figure 2:
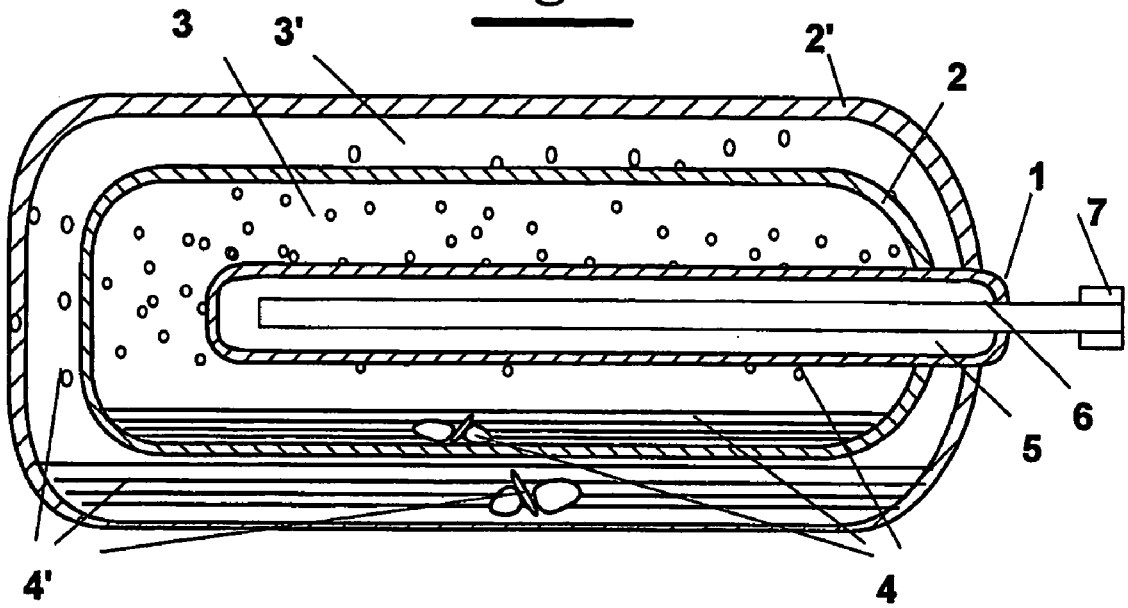
FIG. 2 shows a first different embodiment of the lamp of FIG. 1.

As shown in FIG. 2, the source can be made using more than one exciting antenna, respectively 6 and 6', each antenna residing in a relative recess 5, 5' of a respective inner bulb 1, 1' and being supplied in 7, 7' with a predetermined frequency power. Antennas 6 and 6' can alternatively be housed in a same bulb inner.

The lamp can be shielded and/or equipped with a system of localisation for directing and/or concentrating the emitted radiation (not shown in the figure).

Figure 3:
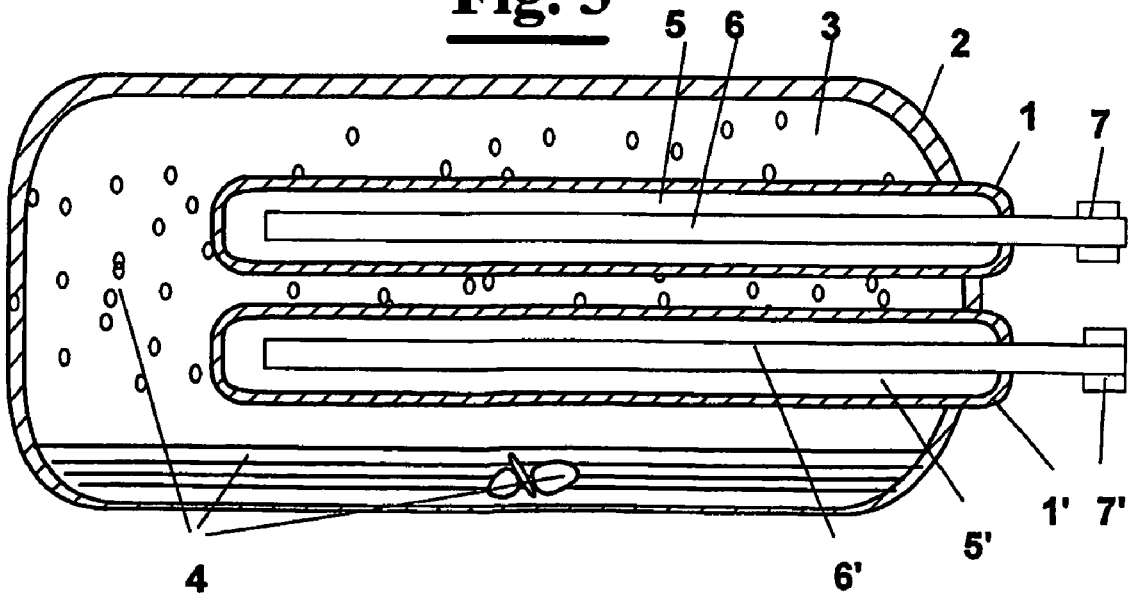
FIG. 3 shows a second different embodiment of the lamp of FIG. 1.

As shown in FIG. 3, according to a further different embodiment of the invention, more than one chamber can be provided, containing each a material excitable by activation. In particular, a chamber 3' can be provided defined by bulb 2 and by a more outer bulb 2'. The material 4' present in chamber 3' can adsorb the microwaves not adsorbed by the material 4 present in chamber 3. Alternatively, the chambers 3 and 3' can be parallel instead of being coaxial. Obviously, other combinations are possible, according to the number of antennas, to the number of chambers and of their mutual arrangement.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What is claimed is:

1. A method for the production of a visible, UV, or IR radiation (9), within a spectral or wide band wavelength range, either pulsed or continuous, comprising the steps of:

creating at least one first chamber (3) closed by an external wall (2) with a substantially transparent material in which a material (4) is disposed capable of being excited by means of microwaves irradiation, said at least one chamber (3) having an internal wall (1) that defines at least one second chamber (5) separated from the at least one first chamber and accessible from the outside;

introducing in said at least one second chamber (5) at least one source (6) of microwave radiation (8), and exciting said at least one source (6) according to a predetermined function of power and frequency, said at least one source (6) emitting a radiation (8) with subsequent excitation of said material in said at least one first chamber (3).

2. Method according to claim 1, wherein said at least one first chamber (3) is obtained by means of introduction of a first bulb (1) in a second bulb (2), in order to form said at least one first chamber (3) closed between the walls of the first (1) and of the second bulb (2), the walls of the first bulb (1) defining said at least one second chamber (5).

3. Method according to claim 1, wherein said source is a thin antenna made of co-axial conductors (6), placed in said at least one second chamber (5).

4. Method according to claim 1, wherein said excitable material (4) is selected from the group consisting of gas, vapor, dust, and liquid, capable of emitting radiation by activation.

5. Method according to claim 1, comprising a plurality of said first chambers, excited by the source (6).

6. Method according to claim 1, comprising a plurality of sources for exciting one or more first chambers.

7. A lamp without electrodes, for the production of a visible, UV, or IR radiation (9), within a spectral or wide band wavelength range, pulsed or continuous, comprising:

an external wall (2) of material substantially transparent to a visible, UV or IR radiation, defining a chamber (3) having therein a material (4) capable of being excited by means of microwave irradiation (8), an internal wall (1) that separates said chamber (3) from a second chamber (5) accessible from the outside;

at least one source (6) of microwave radiation (8) inserted into said recess (5), and means for exciting (7) said at least one source (6) according to a predetermined function of power and frequency.

8. Lamp according to claim 7, comprising a first bulb (1) placed in a second bulb (2) defining said first chamber (3) therebetween, the walls of the first bulb (1) defining said second chamber (5).

9. Lamp according to claim 7, wherein said source is a thin antenna (6) made of co-axial conductors, disposed in said second chamber (5).

10. Lamp according to claim 7, wherein said excitable material (4) is selected from the group consisting of gas, vapor, dust, and liquid, capable of emitting radiation by activation, placed in said first chamber (3).

11. Lamp according to claim 7, wherein a plurality of adjacent first chambers (3, 3') are provided, excited by the source (6) present in said recess (5).

12. Lamp according to claim 7, wherein a plurality sources (6, 6') are provided that excite the first chamber (3) or a plurality of adjacent first chambers (3, 3').

* * * * *